United States Patent [19]

Müller et al.

[11] 4,125,146

[45] Nov. 14, 1978

[54] CONTINUOUS CASTING PROCESSES AND APPARATUS

[76] Inventors: Ernst Müller, Hochgerichtstrasse 26, Wattenheim; Adolf Trautwein, Donaustrasse 53, Gottmadingen, both of Germany

[21] Appl. No.: 744,945

[22] Filed: Nov. 24, 1976

Related U.S. Application Data

[63] Continuation of Ser. No. 665,718, Mar. 10, 1976, abandoned, which is a continuation of Ser. No. 494,161, Aug. 2, 1974, abandoned.

[30] Foreign Application Priority Data

Aug. 7, 1973 [CH] Switzerland ..... 11395/73

[51] Int. Cl.[2] ..... B22D 11/10

[52] U.S. Cl. ..... 164/437; 164/82; 164/134; 164/337; 222/547; 222/591; 222/606; 266/238

[58] Field of Search ..... 164/122, 133, 134, 82, 164/281, 337, 358, 437, 438, 439; 222/547, 564, 607, 591, 606; 249/105; 266/229, 238

[56] References Cited

U.S. PATENT DOCUMENTS

| | | | |
|---|---|---|---|
| 484,659 | 10/1892 | Keiper | 266/229 |
| 535,514 | 3/1895 | Van Reit | 164/134 X |
| 2,493,394 | 1/1950 | Dunn et al. | 164/134 X |
| 2,659,120 | 11/1953 | Harter, Jr. et al. | 222/564 |
| 3,574,603 | 4/1971 | Rassenfoss | 164/133 |
| 3,669,178 | 6/1972 | Theisen | 164/82 X |
| 3,814,167 | 6/1974 | Listhuber et al. | 164/82 |

FOREIGN PATENT DOCUMENTS

| | | | |
|---|---|---|---|
| 2,062,114 | 7/1972 | Fed. Rep. of Germany | 164/281 |

OTHER PUBLICATIONS

Metals Handbook, 8th edition, vol. 5, Jan. 1970, p. 166.

*Primary Examiner*—Francis S. Husar
*Assistant Examiner*—Gus T. Hampilos
*Attorney, Agent, or Firm*—Roylance, Abrams, Berdo & Farley

[57] ABSTRACT

There is disclosed a continuous casting process in which contaminants from a metal melt are separated out by forcing the metal melt to undergo a rotating turbulent flow before it is cast. The desired rotating turbulent flow is achieved by disposing a suitable chamber, through which the melt flows, between the ladle and the mould.

1 Claim, 7 Drawing Figures

Fig. 1
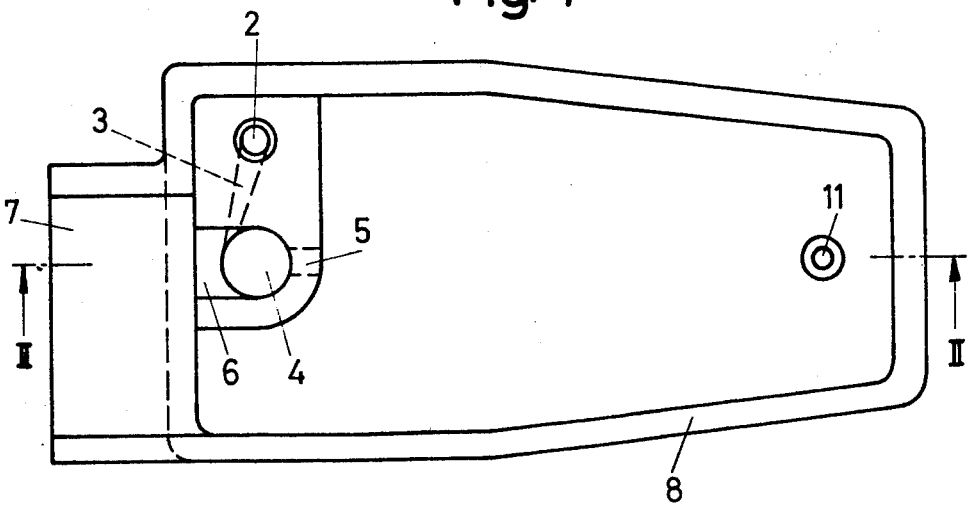
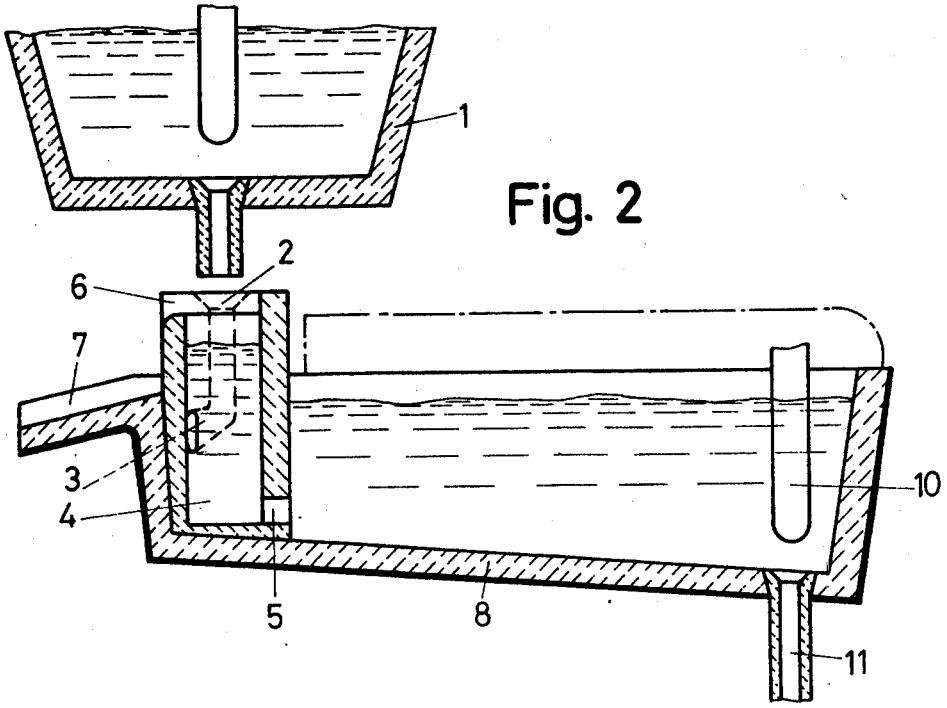
Fig. 2

CONTINUOUS CASTING PROCESSES AND APPARATUS

This is a continuation of application Ser. No. 665,718, filed Mar. 10, 1976 and now abandoned, which is a continuation of application Ser. No. 464,161, filed Aug. 2, 1974 and now abandoned.

This invention relates to the separation of slags and other contaminants from a metal melt in a continuous-casting process.

In a continuous-casting process, molten metal is poured from a ladle into an intermediate vessel, usually a tundish, from which it flows to a mould which is normally vertically disposed. The molten metal, or melt, is generally required to exhibit a high degree of purity, because non-metallic occlusions may lead to serious operational troubles, more particularly casting fractures, and become noticeable in a highly disadvantageous manner when the casting is subjected to further processing, e.g. rolling or drawing. Attempts are made to keep the amount of contaminants low, for example by metallurgical measures, e.g. by desulphurisation, and by choosing suitable fireproof materials in the construction of the plant, but it transpires again and again that such precautions alone are not sufficient.

German Specification No. 1758868 describes a method of separating contaminants from a melt by placing a pouring box, through which the melt runs, directly on a vertical continuous-casting mould. The melt then falls freely from the pouring ladle, which is disposed at a greater height, into the pouring box. In view of the violent turbulence which then occurs and the short retention time of the melt in the pouring box, it must however be doubted that this arrangement has sufficient separating action.

It is furthermore known to pass a melt forcibly through a filter layer incorporated in a holder, said filter layer taking the form either of a woven glass mat (see German Specification No. 2038233) or a layer of slag (see German Specification No. 2020713). In these cases, however, there is a risk that loose parts of the filter layer itself will be torn off, more particularly when starting up the continuous casting process, and in addition it is necessary for the filter layer, which is immersed in the melt, to be cleaned or replaced from time to time and this interrupts the operation and results in additional costs.

It is an object of the present invention to keep melt-contaminants away from the continuous-casting mould in a simple and reliable fashion without interfering with the casting operation.

SUMMARY OF THE INVENTION

According to one aspect of the invention, there is provided in a continuous casting process, the improvement which comprises separating out contaminants from a metal melt, by forcing the metal melt to undergo a rotating turbulent or vortex flow on its way to a mould.

According to another aspect of the invention, there is provided in a continuous-casting apparatus the improvement which comprises providing at least one means for imparting rotating turbulent-flow to a metal melt.

In the present invention, advantageous use is made of the kinetic energy of the continuously flowing melt, the invention being effective for foaming contaminants and useable without interruption of the casting process. A turbulent-flow chamber, which in preferred embodiments is incorporated in an intermediate vessel or tundish, furthermore constitutes a robust element which offers only small working surfaces to the melt.

DESCRIPTION OF EMBODIMENTS OF THE INVENTION

For a better understanding of the invention, and to show more clearly how the same may be carried into effect, reference will now be made to the accompanying drawings in which:

FIG. 1 is a plan view of an intermediate vessel of a continuous-casting apparatus which incorporates a turbulent-flow chamber;

FIG. 2 is a section taken along the line II — II of FIG. 1 and a through a pouring ladle;

Figure 3:
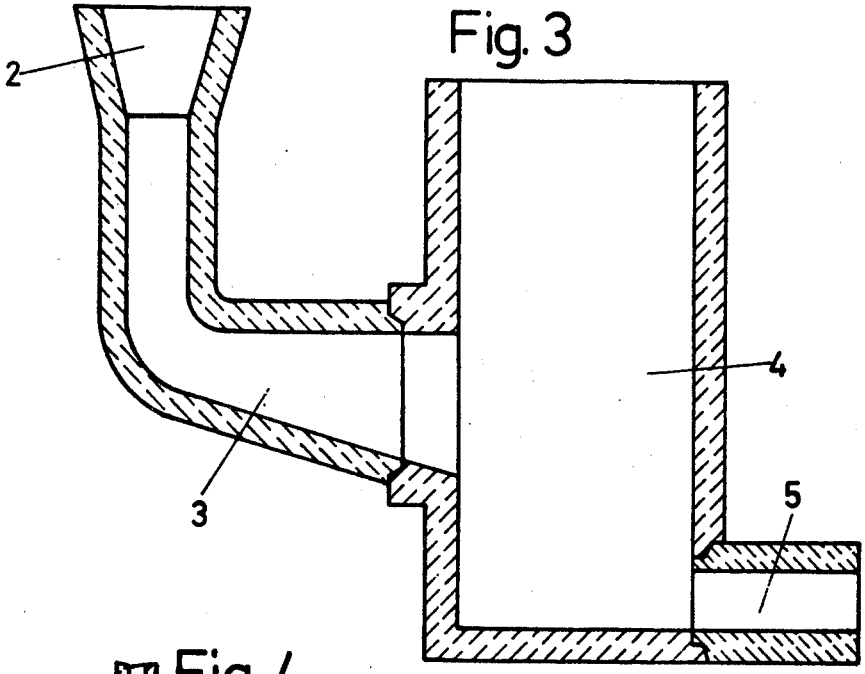
Figure 4:
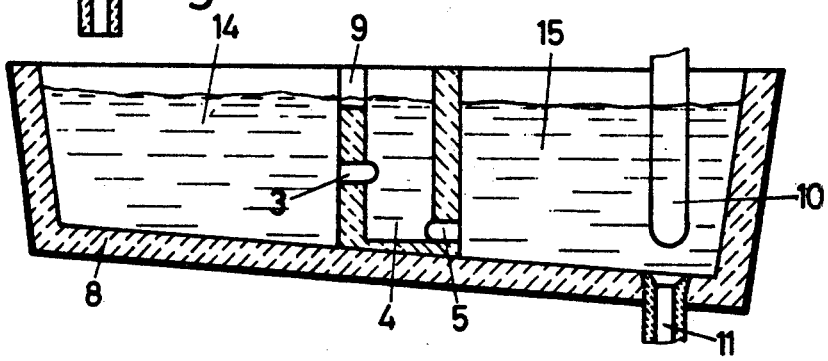
Figure 5:
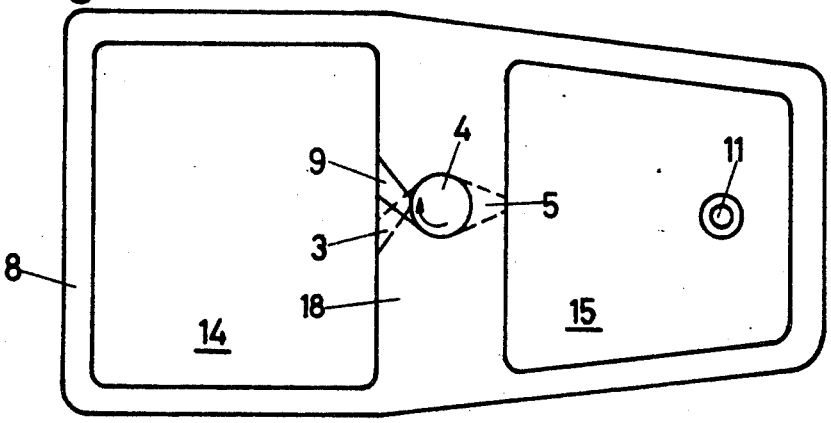
Figure 6:
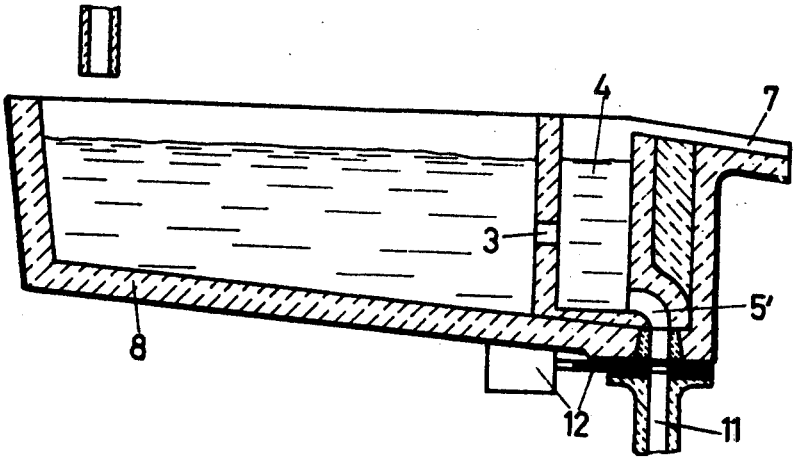
Figure 7:
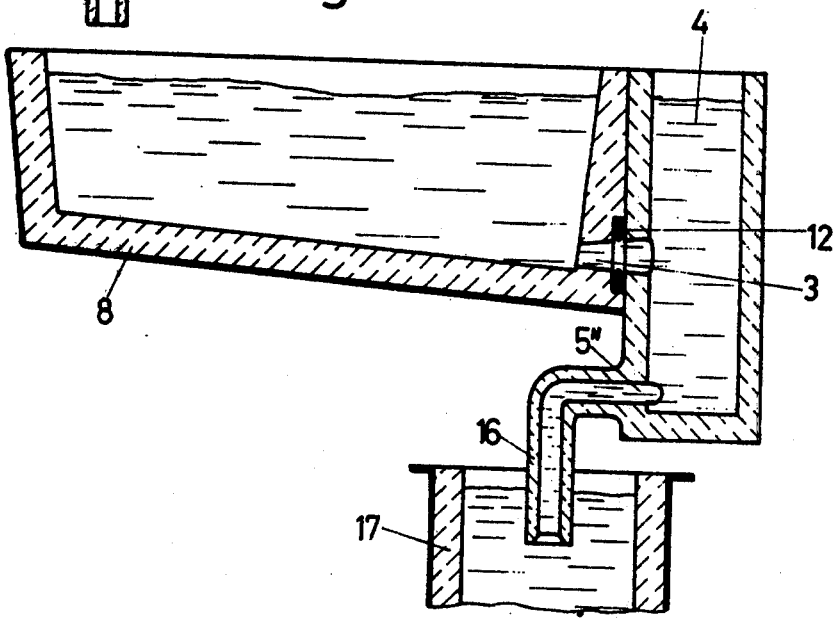

FIG. 3 diagrammatically shows a turbulent-flow chamber in vertical section;

FIG. 4 shows in vertical section another embodiment of the invention;

FIG. 5 is a plan view of the embodiment of FIG. 4;

FIG. 6 shows a further embodiment of the invention also in vertical section; and FIG. 7 shows a still further embodiment of the invention in vertical section.

Referring first to FIGS. 1 and 2, a molten metal, for example a steel, is fed tangentially from a transport ladle 1 with a plug closure into a turbulent-flow chamber 4 via an inlet funnel 2 and a junction pipe 3. As a result of the kinetic energy acquired by the falling molten metal and the disposition of the chamber 4, funnel 2 and pipe 3, the molten metal is forced to assume a rotating turbulent flow in the chamber 4. The centrifugal forces associated with the rotation result in accelerated and highly effective separation between the melt and the specifically lighter contaminants, which collect in the centre of the rotating turbulence and rise upwards. The contaminants can collect unhindered in the chamber 4, which is open at the top, and if desired allowed to run away or be removed via an overflow 6, 7.

The cleaned metal leaves the turbulent-flow chamber 4 at the bottom, via an outlet 5, in a radial direction, and passes into an intermediate vessel or tundish 8, of a continuous-casting plant. From this vessel the continuous-casting mould (not illustrated) is supplied in the usual manner with molten metal via a closure device consisting of a plug 10 and an outlet 11.

FIG. 3 shows more clearly in section (and illustrated in simplified fashion in one plane) a suitable construction for a turbulent-flow chamber 4, with an inlet funnel 2 and a junction pipe 3. The turbulent-flow chamber 4, as such, and the outlet 5 can be made of preformed finished components, which may easily be incorporated in a suitable place in the intermediate vessel, or tundish, 8 or outside the same.

Incorporating the turbulent-flow chamber in the intermediate vessel 8, as illustrated, has a number of advantages: firstly, the inlet funnel 2 catches the stream being poured from the ladle 1, whereupon any air carried along is also separated out of the melt in the turbulent-flow chamber 4 in addition to contaminants; secondly the melt can be passed into the intermediate vessel 8 without disturbing the slag covering, the cleaned metal emerges from the chamber 4 through the outlet 5 near the bottom and then fills the intermediate vessel 8 without any turbulence phenomena, so that there is no risk of pieces of slag from the covering thereof being carried along, and there is no increased erosion of the fireproof material of the lining.

The turbulent-flow chamber may be incorporated in the intermediate chamber in various places different from that shown in FIGS. 1 and 2 and FIGS. 4, 5 and 6 show examples of alternative arrangements. In order to achieve the highest degree of cleanliness, a manner of incorporation in which the chamber 4 is immediately before the outlet 11, as shown in FIG. 6, is preferred, since here also any contaminations in the melt which may yet be formed in the intermediate vessel are separated out directly before entering the continuous-casting mould. In this embodiment, the outlet merges in the form of an enclosed arcuate pipe 5' directly into the outlet 11 which forms a pouring pipe which is then equipped with a base closure 12 for example in the form of a slide-valve closure member.

In the case of the embodiment shown in FIGS. 4 and 5, the turbulent-flow chamber 4 is incorporated between the inlet and outlet of the intermediate vessel in a dam 18 which extends right through, and which subdivides, the intermediate vessel 8 into two basins 14 and 15. Any contaminants or slag are thus effectively prevented from passing from the basin 14 to the basin 15. In this connection, the chamber 4 is linked to the basin 14 on the inlet side via a cut-away portion 9 in the dam 18 at the top. This cut-away portion 9 reaches somewhat lower than the level of the melt in the basin 14, which has the results of preventing "freezing", i.e. the production of a solidified covering, in the turbulent-flow chamber 4. As may be seen from FIG. 5, the inlet 3 and the cut-away portion 9 are advantageously directed at opposite tangents to the chamber 4; there is then a tendency that the sense of rotation imparted to the turbulence (see arrow in FIG. 5) by the direction of the inlet 3 will enable the slag collecting at the top in the chamber 4 to be drawn off via the cut-away portion 9 towards the surface of the melt in the basin 14.

It should be noted that the turbulent-flow chamber may be disposed wherever the melt runs through and need not be in the intermediate vessel.

In the embodiment shown in FIG. 7, the turbulent-flow chamber 4 is arranged not in the intermediate vessel 8, but between the latter and a continuous-casting mould 17. Among other things, this enables the chamber 4 to be made of greater height, and good use can be made of the increased drop for greater turbulence-formation. Furthermore, the melt is cleaned immediately before entering the mould 17, so that practically no new contaminants can occur in the melt itself. As illustrated, the turbulent-flow chamber 4 is preferably fastened externally to the intermediate vessel 8, whereof the outlet is constituted by the inlet 3 to the chamber 4 and includes a slide-valve closure member 12. The outlet 5'' of the chamber 4 merges directly into a pouring pipe 16 which dips into the mould 17. The contaminants separated out from the melt and collecting at the top in the chamber 4 can run over unhindered automatically or be skimmed off from time to time. In this connection no interruption whatever occurs in the course of the continuous pouring operation is the separating action impaired. It is also possible to provide a plurality of turbulent-flow chambers in series or in parallel with one another in the path of the melt as it flows to the mould.

It has proved to be advantageous to make the turbulent-flow chamber as a finished component, so that easy and quick incorporation is possible each time the intermediate vessel is newly set up. In order to achieve high resistance to wear, for example with respect to steel melts, a highly fireproof material should be used in making the turbulent-flow chamber and the material used in preferably corundum.

It will be seen that in the preferred, but not limiting, embodiments of the invention described above there is provided, in a continuous casting apparatus which comprises a ladle, an intermediate vessel or tundish, and a mould so arranged that, in use, molten metal flows from the ladle to the intermediate vessel and thence to the mould, a chamber disposed between the ladle and the mould which chamber is constructed and arranged so that a rotating turbulent flow can be imparted to the melt at some stage in its path from the ladle to the mould.

We claim:

1. In a continuous-casting installation which comprises a ladle, a tundish and a mould in which molten metal flows from the ladle to the tundish and then to the mould, the improvement for continuously removing lightweight contaminants from the continuously flowing molten metal comprising:

a dam extending completely across said tundish in the middle thereof subdividing said tundish into a first basin and a second basin;

a ladle outlet positioned over said first basin adjacent the side thereof spaced from said dam for delivering molten metal to said first basin;

a confined chamber located along the molten metal flow path in said dam;

said chamber having inlet means associated therewith for introducing molten metal into said chamber from said first basin and for creating a rotating vortex flow of the molten metal only in said chamber about a vertical axis, and outlet means associated with said chamber for continuously discharging molten metal from said chamber into said second basin;

said outlet means being located below said inlet means;

said chamber further having contaminant discharge means, separate from said outlet means, for continuously discharging contaminants in the molten metal from said chamber into said first basin, which contaminants rise to the top of said chamber via the action of the rotating vortex flow;

said contaminant discharge means being located above said inlet means adjacent the top of said chamber; and a tundish outlet, for conducting molten metal to said mould, located in the bottom of said second basin adjacent the side of said second basin spaced from said dam.

* * * * *